US011443699B2

(12) United States Patent
Im et al.

(10) Patent No.: US 11,443,699 B2
(45) Date of Patent: Sep. 13, 2022

(54) DATA DRIVING CIRCUIT AND DISPLAY DEVICE INCLUDING THE SAME

(71) Applicant: Samsung Display Co., Ltd., Yongin-Si (KR)

(72) Inventors: Tae Gon Im, Yongin-si (KR); Jong Jae Lee, Yongin-si (KR); Jun Pyo Lee, Yongin-si (KR); Byung Kil Jeon, Yongin-si (KR); Won Hee Lee, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/467,482

(22) Filed: Sep. 7, 2021

(65) Prior Publication Data

US 2022/0215805 A1 Jul. 7, 2022

(30) Foreign Application Priority Data

Jan. 4, 2021 (KR) ..... 10-2021-0000542

(51) Int. Cl.

| | |
|---|---|
| ***G09G 3/3275*** | (2016.01) |
| ***G09G 5/00*** | (2006.01) |
| *G09G 3/32* | (2016.01) |

(52) U.S. Cl.

CPC ..... *G09G 3/3275* (2013.01); *G09G 5/008* (2013.01); *G09G 3/32* (2013.01); *G09G 2310/0243* (2013.01); *G09G 2310/08* (2013.01); *G09G 2330/028* (2013.01); *G09G 2370/00* (2013.01)

(58) Field of Classification Search

CPC ..... G09G 3/3275; G09G 5/008; G09G 3/32; G09G 2310/08; G09G 2330/028; G09G 2370/00

See application file for complete search history.

(56) References Cited

U.S. PATENT DOCUMENTS

| | | | | |
|---|---|---|---|---|
| 8,314,763 | B2 | 11/2012 | Park et al. | |
| 2015/0187315 | A1* | 7/2015 | Park | G09G 5/008 345/99 |
| 2020/0184877 | A1* | 6/2020 | Pyun | G09G 3/3688 |
| 2020/0243035 | A1* | 7/2020 | Tanaka | H01L 27/1225 |
| 2020/0251036 | A1 | 8/2020 | Kim et al. | |

FOREIGN PATENT DOCUMENTS

| | | | |
|---|---|---|---|
| KR | 10-1367279 | B1 | 2/2014 |
| KR | 10-2020-0094912 | A | 8/2020 |

* cited by examiner

*Primary Examiner* — Abbas I Abdulselam
(74) *Attorney, Agent, or Firm* — Innovation Counsel LLP

(57) ABSTRACT

A display device includes a display panel having pixels. A timing controller generates a first control signal and data control signals. Data driving circuits each recover a data signal from a corresponding data control signal of the data control signals in response to the first control signal, generate a data voltage corresponding to the data signal, and provide the data voltage to the display panel. Each of the data driving circuits includes: a setting unit configured to acquire a setting value from the data control signal; an equalizer configured to compensate for distortion of the corresponding data control signal according to the setting value to output compensated data control signal; and a recoverer configured to recover a clock signal from the compensated data control signal and recover the data signal from the compensated data control signal based on the clock signal.

20 Claims, 7 Drawing Sheets

DATA DRIVING CIRCUIT AND DISPLAY DEVICE INCLUDING THE SAME

CROSS-REFERENCE TO RELATED APPLICATION

This application claims priority to and the benefit of Korean Patent Application No. 10-2021-0000542 filed in the Korean Intellectual Property Office on Jan. 4, 2021, the entire contents of which are incorporated herein by reference.

BACKGROUND

1. Field

The present disclosure generally relates to a display device. More particularly, the present disclosure relates to a display device including a data driving circuit capable of setting an equalizer using an intra-panel interface.

2. Description of the Related Art

Display devices such as liquid crystal display devices or organic light-emitting display devices transmit a variety of data through an intra-panel interface constructed between a timing controller and a data driving circuit (or source driver or source drive IC).

When a data rate of the intra-panel interface is increased, signal distortion (or signal loss) is increased, and thus, the signal integrity of frame data is degraded. Accordingly, the data driving circuit may include a recovery circuit (for example, an equalizer) for recovering a signal distorted during a transmission process.

SUMMARY

Since a data rate, a transmission line, and the like of an intra-panel interface are different for each display device, and a degree of signal distortion is different for each data driving circuit in the display device, there is a need for a separate interface for defining an equalizer setting value for each data driving circuit (that is, an interface distinct from the intra-panel interface).

One embodiment of the present disclosure provides a data driving circuit capable of setting an equalizer using an intra-panel interface, and a display device including the same.

In order to achieve one object of the present disclosure, a display device according to embodiments of the present disclosure includes: a display panel including pixels; a timing controller configured to generate a first control signal and data control signals; and data driving circuits which each recover a data signal from a corresponding data control signal of the data control signals in response to the first control signal, generate a data voltage corresponding to the data signal, and provide the data voltage to the display panel, wherein each of the data driving circuits includes: a setting unit configured to acquire a setting value from the data control signal; an equalizer configured to compensate for distortion of the corresponding data control signal according to the setting value to output the compensated data control signal; and a recoverer configured to recover a clock signal from the compensated data control signal and recover the data signal from the compensated data control signal based on the clock signal According to one embodiment, the display device may further include a first sharing signal line connected in common to the data driving circuits and configured to transmit the first control signal from the timing controller to the data driving circuits; and data clock signal lines respectively connected to the data driving circuits and configured to respectively transmit the data driving control signals.

According to one embodiment, the first sharing signal line may be a one-way transmission line from the timing controller to the data driving circuits, and each of the data clock signal lines may be a one-way transmission line from the timing controller to each of the data driving circuits.

According to one embodiment, at least some of the data control signals may include different setting values for the equalizer.

According to one embodiment, the setting unit may include a first switch and a second switch connected in parallel between the timing controller and the equalizer, the first switch may transmit the data control signal as the setting value at a first transmission rate in a first period, the second switch may transmit the data control signal at a second transmission rate in a second period after the first period, and the second transmission rate may be 10 times or more faster than the first rate.

According to one embodiment, the setting unit may further include a controller configured to acquire the setting value from the corresponding data control signal provided through the first switch in response to the first control signal having a first pattern.

According to one embodiment, in a first period, the setting unit may acquire the setting value from the data control signal using the first control signal as an external clock signal.

According to one embodiment, the data driving circuits may simultaneously set the equalizers in the first period.

According to one embodiment, in the first period, the setting unit may extract the setting value from the corresponding data control signal in response to a rising edge of each of pulses included in the first control signal.

According to one embodiment, in the first period, the setting unit may extract the setting value from the corresponding data control signal in response to a falling edge of each of pulses included in the first control signal.

According to one embodiment, in a first sub-period of a second period, the recoverer may recover the clock signal from the compensated data control signal, in a second sub-period after the first sub-period of the second period, the recoverer may recover the data signal from the compensated data control signal based on the clock signal, and the second period may be allocated after the first period.

According to one embodiment, each of the data driving circuits may further include: an input buffer connected between the timing controller and the setting unit and configured to amplify and output the corresponding data control signal; and a data voltage generator configured to generate a data voltage corresponding to the data signal output from the recoverer.

According to one embodiment, the setting unit may acquire the setting value in response to the first control signal having a first pattern, the recoverer may recover the clock signal in response to the first control signal having a first value and recovers the data signal in response to the first control signal having a second value, and the first pattern may include a transition twice or more between the first value and the second value for a specific time.

In order to achieve one object of the present disclosure, a data driving circuit according to embodiments of the present disclosure receives a data control signal through a first input terminal. The data driving circuit includes: a setting unit configured to acquire a setting value from the data control signal; an equalizer configured to compensate for distortion of the data control signal according to the setting value and output the compensated data control signal; a recoverer configured to recover a clock signal from the compensated data control signal and recover a data signal from the compensated data control signal based on the clock signal; and a data voltage generator configured to generate a data voltage corresponding to the data signal output from the recoverer.

According to one embodiment, the setting unit may include a first switch and a second switch connected in parallel between the timing controller and the equalizer, the first switch may transmit the data control signal as the setting value at a first transmission rate in a first period, the second switch may transmit the data control signal at a second transmission rate in a second period after the first period, and the second transmission rate may be 10 times or more faster than the first rate.

According to one embodiment, in the first period, the setting unit may acquire the setting value from the data control signal using a first control signal provided through a second input terminal as an external clock signal.

According to one embodiment, in the first period, the setting unit may extract the setting value from the corresponding data control signal in response to a rising edge of each of pulses included in the first control signal.

According to one embodiment, in the first period, the setting unit may extract the setting value from the corresponding data control signal in response to a falling edge of each of pulses included in the first control signal.

According to one embodiment, in a first sub-period of the second period, the recoverer may recover the clock signal from the data control signal, and in a second sub-period after the first sub-period of the second period, the recoverer may recover the data signal from the compensated data control signal based on the clock signal.

According to one embodiment, the data driving circuit may further include comprising an input buffer connected between the first input terminal and the setting unit and configured to amplify and output the corresponding data control signal.

DETAILED DESCRIPTION

Figure 1:
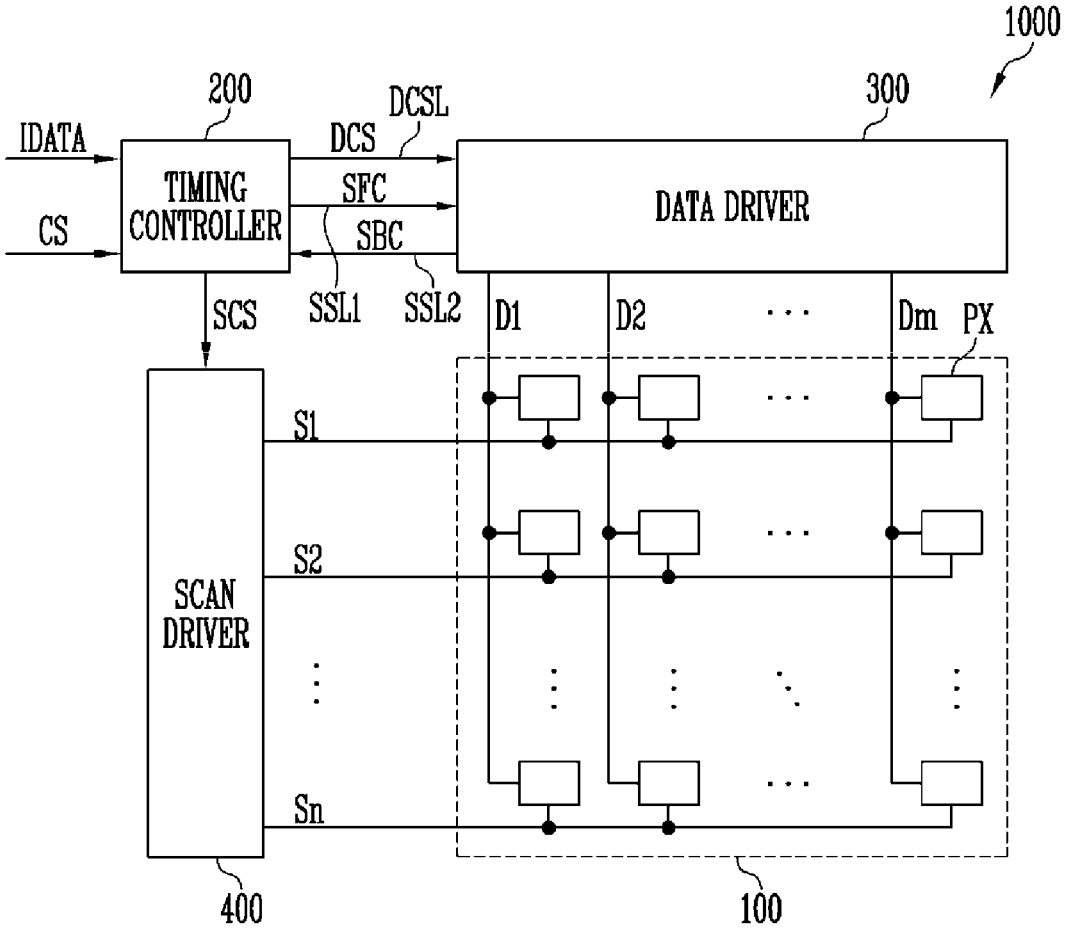
FIG. 1 is a diagram illustrating a display device according to embodiments of the present disclosure.

Hereinafter, embodiments of the present disclosure will be described in more detail with reference to the accompanying drawings so as to be easily realized by those skilled in the art to which the present disclosure belongs. The present disclosure may, however, be embodied in different forms and should not be constructed as limited to the embodiments set forth herein.

In addition, parts irrelevant to description are omitted in the drawings in order to clearly explain the present disclosure. The same reference numerals are allocated to the same or similar components throughout this specification. Therefore, previously described reference numerals may be used in other drawings.

Also, since sizes and thicknesses of components in drawings are arbitrarily shown for convenience of description, the sizes and thicknesses are not limited thereto. In the drawing of the present specification, thicknesses may be exaggerated in order to clearly show various layers and regions.

As is customary in the field, some example embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some example embodiments may be physically separated into two or more interacting and discrete blocks, units, and/or modules without departing from the scope of the inventive concepts. Further, the blocks, units, and/or modules of some example embodiments may be physically combined into more complex blocks, units, and/or modules without departing from the scope of the inventive concepts.

FIG. 1 is a diagram illustrating a display device according to embodiments of the present disclosure.

Referring to FIG. 1, a display device 1000 may include a display unit 100 (or display panel), a timing controller 200, a data driver 300, and a scan driver 400.

The display unit 100 may include scan lines S1 to Sn, data lines D1 to Dm, and pixels PX.

Each of the pixels PX may be connected to at least one of the scan lines S1 to Sn and one of the data lines D1 to Dm. Each of the pixels PX may receive a scan signal through a corresponding scan line among the scan lines S1 to Sn and may receive a data voltage through a corresponding data line among the data lines D1 to Dm. For example, each of the pixels PX may store or record a data voltage in response to a scan signal and may emit light with a gray scale corresponding to the data voltage. Each of the pixels PX may include one or more light-emitting elements. The light-emitting element may include an organic light-emitting diode (LED) or an inorganic LED such as a micro LED or a quantum dot LED. In addition, the LED may be a light-emitting element made of organic and inorganic materials in combination. When the pixel PX includes the plurality of light-emitting elements, the plurality of light-emitting elements may be connected in series, parallel, or series-parallel.

The timing controller 200 may receive a control signal CS and input image data DATA from an external device (for example, a graphic processor). The timing controller 200 may generate a scan control signal SCS based on the control signal CS and may generate a data control signal DCS based on the control signal CS and the input image data DATA. Here, the control signal CS may include a vertical synchronization signal, a horizontal synchronization signal, and the like.

The data control signal DCS may include a clock training signal and image data (or data signal). Here, the clock training signal may include a clock training pattern, and the image data may include pixel data and the like. In addition, the data control signal DCS may further include an equalizer setting value (or equalizer option value or equalizer setting signal). As will be described below, the equalizer setting value may be a value (for example, a code) for setting a gain (or frequency gain) and/or a frequency band of an equalizer. The equalizer setting value will be described below with reference to FIG. 4.

In one embodiment, the timing controller 200 may output an equalizer setting value to a data clock signal line DCSL in a first period of one frame, may output a clock training signal to the data clock signal line DCSL in a second period of one frame, and may provide pieces of image data through the data clock signal line DCSL in a third period of one frame. Here, the data clock signal line DCSL may be a high speed serial interface. For example, the data clock signal line DCSL may be a universal serial interface (USI), a universal serial interface for TV (USI-T), or universal description, discovery, and integration (UDDI).

The first period, the second period, and the third period may be different periods. For example, the first period and the second period may be included in a vertical blank period (VBP), the second period may be allocated after the first period, and the third period may include an active data period (ADP). The VBP may be a transition period in which image data is not supplied and the process proceeds to the next frame. The ADP may be a supply period of image data corresponding to an image to be displayed by the display unit 100. As will be described below, an equalizer in the data driver 300 (or data driving circuit) is a component for compensating for signal distortion in a high speed serial interface, and in order to apply the high speed serial interface, the equalizer should first be set. Accordingly, in the first period, an equalizer setting value for setting an equalizer may be transmitted through the data clock signal line DCSL. Since the equalizer setting value is transmitted before the high speed serial interface is applied (i.e., the equalizer setting value is distorted when a data rate is high), the equalizer setting value may be transmitted at a relatively low rate (for example, at a rate of several MHz to hundred MHz) through the data clock signal line DCSL. After the setting of the equalizer is completed, that is, after the high speed serial interface is applied, a clock training signal and pieces of image data may be transmitted at a relatively high rate (for example, at a rate of several GHz) through the data clock signal line DCSL.

The timing controller 200 may output a first control signal SFC (or equalizer setting notification signal) having a first pattern to a first sharing signal line SSL1 in order to provide notification of the transmission of the equalizer setting value in the first period. In addition, the timing controller 200 may output the first control signal SFC (or training notification signal) having a first value (or first level, for example, a logic low level) to the first sharing signal line SSL1 in order to provide notification of the transmission of the clock training signal in the second period. Furthermore, the timing controller 200 may output the first control signal SFC (or training notification signal) having a second value (or second level, for example, a logic high level) to the first sharing signal line SSL1 in order to provide notification of the transmission of the data signal in the third period.

The first control signal SFC has only the first value and second value based on a signal level. The first control signal SFC having the first value may be used for the clock training signal, and the first control signal SFC having the second value may be used for the data signal. Accordingly, the first control signal used for the equalizer setting value may have the first pattern in which the first value and the second value are combined. For example, the first pattern may be set to include a transition twice or more between the first value and the second value for a specific time. In addition, a separate clock signal may be required to accurately extract or sample the equalizer setting value transmitted at a relatively low rate. According to embodiments, the first pattern may have a waveform of a clock signal periodically having the first value and the second value, and in this case, the first control signal SFC having the first pattern may be used as a clock signal for extracting or sampling the equalizer setting value.

The data driver 300 may receive the data control signal DCS from the timing controller 200 through the data clock signal line DCSL and may receive the first control signal SFC from the timing controller 200 through the first sharing signal line SSL1. In one embodiment, the data driver 300 may receive the equalizer setting value through the data clock signal line DCSL in the first period, may receive the clock training signal through the data clock signal line DCSL in the second period, and may receive the pieces of image data through the data clock signal line DCSL in the third period. In addition, the data driver 300 may receive the first control signal SFC having the first pattern through the first sharing signal line SSL1 in the first period, may receive first the first control signal SFC having the first value through the first sharing signal line SSL1 in the second period, and may receive the first control signal SFC having the second value through the first sharing signal line SSL1 in the third period.

The data driver 300 may set the equalizer provided therein according to the equalizer setting value in response to the first control signal SFC having the first pattern in the first period, may set or recover a clock signal according to the clock training signal in response to the first control signal SFC having the first value in the second period, and may sequentially recover the pieces of image data using the recover clock signal in response to the first control signal SFC having the second value in the third period. Furthermore, the data driver 300 may generate data voltages based on the recovered clock signal and the recovered pieces of image data and may provide the data voltages to the data lines D1 to Dm.

A detailed configuration of the data driver 300 will be described below with reference to FIG. 3A.

In one embodiment, the data driver 300 may supply a second control signal SBC (or feedback signal) indicating whether a clock signal is recovered in the second period to the timing controller 200 through a second sharing signal line SSL2. For example, when the data driver 300 normally recovers the clock signal in the second period or a reception state of the data driver 300 is a normal state in the third period, the data driver 300 may supply the second control signal SBC having a first value to the timing controller 200 through the second sharing signal line SSL2. For another example, when the data driver 300 does not normally recover the clock signal in the second period or the reception state of the data driver 300 is an abnormal state in the third period, the data driver 300 may supply the second control signal SBC having a second value to the timing controller 200 through the second sharing signal line SSL2. Here, the reception state being the abnormal state may mean a case in which the locking of the clock signal fails due to electrostatic discharge or the like. Meanwhile, in the first period, since the data driver 300 does not recover the clock signal or the like, the second control signal SBC may not be transmitted through the second sharing signal line SSL2 in the first period.

The second sharing signal line SSL2 is formed as a line (or channel) separate from the first sharing signal line SSL1. In this case, the first sharing signal line SSL1 may be formed to enable one-way signal transmission from the timing controller 200 to the data driver 300, and the second sharing signal line SSL2 may be formed to enable one-way signal transmission from the data driver 300 to the timing controller 200.

The scan driver 400 may generate scan signals based on the scan control signal SCS provided from the timing controller 200. Here, the scan control signal SCS may include a scan start signal, a scan clock signal, and the like. The scan driver 400 may sequentially provide the scan signals to the scan lines S1 to Sn. For example, the scan driver 400 may sequentially provide scan signals having a turn-on level pulse to the scan lines S1 to Sn. In one embodiment, the scan driver 400 may generate scan signals by sequentially transferring a turn-on level pulse to a next scan stage according to a scan clock signal. For example, the scan driver 400 may be formed in the form of a shift register.

As described above, the timing controller 200 may provide the data control signal DCS sequentially including the equalizer setting value, the clock training signal, and the pieces of image data to the data driver 300 through the data clock signal line DCSL and may sequentially control an equalizer writing operation, a clock signal recovery operation, and an image data recovery operation of the data driver 300 using the first control signal SSL1 that is transmitted through the first sharing signal line SSL1 and sequentially has the first pattern, the first value, and the second value. In particular, the timing controller 200 may output the equalizer setting value at a relatively low rate before the equalizer in the data driver 300 is set and may sequentially output the clock training signal and the pieces of image data at a relatively high rate after the equalizer is set (that is, after a high speed serial interface is applied). Since the equalizer setting value is transmitted through the data clock signal line DCSL and the equalizer writing operation is also controlled through the first control signal SFC transmitted through the first sharing signal line SSL1, there may be no need for a separate interface (or channel) for transmitting the equalizer setting value or controlling the equalizer writing operation. That is, the manufacturing costs of the display device 1000 can be reduced.

For reference, the equalizer setting value may be transmitted through the first sharing signal line SSL1 instead of the data clock signal line DCSL in sequence (i.e., in a time division method). However, when the display device has a large area and thus when the number of data driving circuits (see "310" of FIG. 2) in the data driver 300 increases, a time for setting an equalizer of each of the data driving circuits may increase. In particular, when a failure occurs in the data driver 300 (or data driving circuits), such as a case in which the locking of a clock signal fails due to electrostatic discharge or the like, it may be taken a relatively long recovery time for the data driver 300 to be normally operated after the occurrence of the failure of the data driver 300. Accordingly, in the display device 1000 according to embodiments, the equalizer setting value is simultaneously transmitted to the data driving circuits in the data driver 300 through the data clock signal line DCSL, and the equalizers provided in the data driving circuits are simultaneously set, thereby preventing an increase in recovery time.

Figure 2:
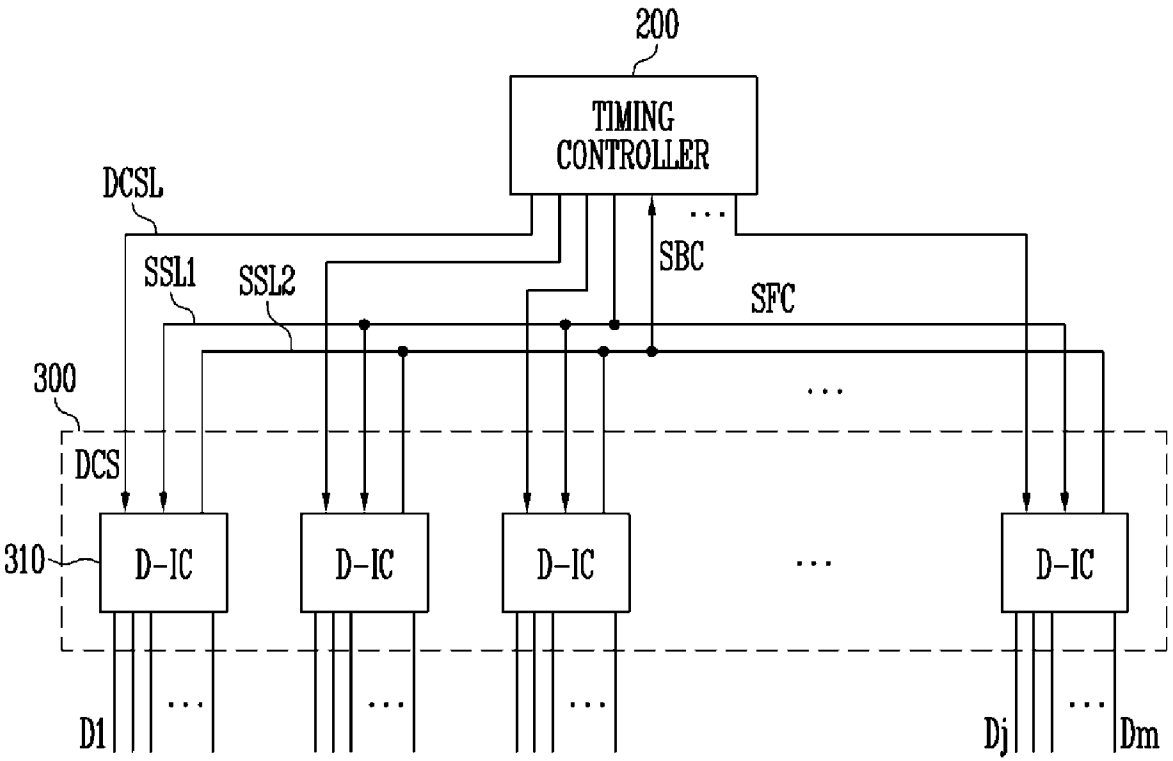
FIG. 2 is a diagram illustrating an example of signal lines connecting a timing controller and data driving circuits included in the display device of FIG. 1.

FIG. 2 is a diagram illustrating an example of signal lines connecting a timing controller and data driving circuits included in the display device of FIG. 1.

Referring to FIGS. 1 and 2, a data driver 300 may include data driving circuits 310. Here, the data driving circuits 310 may also be referred to as driver ICs (D-ICs) or source ICs.

The data driving circuits 310 may be connected to at least one data line of data lines D1 to Dm. For example, when the data driver 300 includes only one data driving circuit 310, the data driving circuit 310 may be identical to the data driver 300. In this case, all of the data lines D1 to Dm may be connected to one data driving circuit 310. For another example, when the data driver 300 includes the plurality of data driving circuits 310, the data lines D1 to Dm may be grouped, and each data line group may be connected to a corresponding data driving circuit 310. For example, the data driver 300 may include m data driving circuits 310. In this case, each of data line groups may include one data line, and m data driving circuits 310 may be connected to the m data lines D1 to Dm (or data line groups). For another example, the data driving circuits 310 may include m/320 data driving circuits 310. In this case, each of data line groups may include 320 data lines, and each of the m/320 data driving circuits 310 may be connected to 320 data lines (or data line groups) of the m data lines D1 to Dm.

A timing controller 200 and the data driver 300 may be connected through a data clock signal line DCSL and a first sharing signal line SSL1.

In one embodiment, the timing controller 200 may be connected to each of the data driving circuits 310 through the data clock signal line DCSL. For example, a method in which the timing controller 200 is connected to the data driving circuits 310 through the data clock signal line DCSL may be a point-to-point method. Here, the data clock signal line DCSL may include sub-data clock signal lines corresponding to the number of the data driving circuits 310. Accordingly, the timing controller 200 may be connected to the data driving circuits 310 through the sub-data clock signal lines.

The data clock signal line DCSL may correspond to an interface (for example, a USI or USI-T) for transmitting a data control signal DCS provided from the timing controller 200 to the data driver 300 (or data driving circuits 310). Here, the data control signal DCS may be data including or embedded with a clock and may also be data including an equalizer setting value. As described above, the data control signal DCS may include the equalizer setting value in a first period, a clock training signal in a second period, and pieces of image data in a third period. In this case, since the timing controller 200 and the data driving circuits 310 are connected through the data clock signal line DCSL, the timing controller 200 may supply the data control signal DCS corresponding to each of the data driving circuits 310 through the data clock signal line DCSL. For example, the timing controller 200 may supply the data control signals DCS including different equalizer setting values to at least some of the data driving circuits 310 through the data clock signal line DCSL.

In one embodiment, the timing controller 200 may be connected in common to the data driving circuits 310 through a first sharing signal line SSL1. For example, a method in which the timing controller 200 is connected to the data driving circuits 310 through the first sharing signal line SSL1 may be a multi-drop method.

The first sharing signal line SSL1 may correspond to a one-way signal transmission channel formed from the timing controller 200 to the data driver 300 (or data driving circuits 310). The first sharing signal line SSL1 may be a signal transmission channel for transmitting a first control signal SFC provided from the timing controller 200 to the data driver 300 (or data driving circuits 310).

As described above, in the first period in which the timing controller 200 supplies the equalizer setting value to the data driver 300 through the data clock signal line DCSL, in order to provide notification of the transmission of the equalizer setting value, the timing controller 200 may supply the first control signal SFC having a first pattern (for example, including a transition twice or more between a first value and a second value) to the data driver 300 through the first sharing signal line SSL1.

Since the timing controller 200 is connected in common to the data driving circuits 310 through the first sharing signal line SSL1, the timing controller 200 may simultaneously supply the first control signal SFC having the first pattern for providing notification of the supply of the equalizer setting value in the first period to all data driving circuits 310 through one first sharing signal line SSL1. Accordingly, the data driving circuits 310 may simultaneously perform an equalizer writing operation.

In the second period in which the timing controller 200 supplies the clock training signal to the data driver 300 through the data clock signal line DCSL, in order to provide notification of the transmission of the clock training signal, the timing controller 200 may supply the first control signal SFC having the first value to the data driver 300 through the first sharing signal line SSL1. In the third period in which the timing controller 200 supplies the pieces of image data to the data driver 300 through the data clock signal line DCSL, in order to provide notification of the transmission of the pieces of image data, the timing controller 200 may supply the first control signal SFC having the second value to the data driver 300 through the first sharing signal line SSL1.

In one embodiment, the timing controller 200 may be connected in common to the data driving circuits 310 through a second sharing signal line SSL2. For example, a method in which the timing controller 200 is connected to the data driving circuits 310 through the second sharing signal line SSL2 may be a multi-drop method.

The second sharing signal line SSL2 may correspond to a one-way signal transmission channel from the data driver 300 (or the data driving circuits 310) to the timing controller 200. The second sharing signal line SSL2 may correspond to a signal transmission channel for transmitting a second control signal SBC provided from the data driver 300 to the timing controller 200. In addition, the data driver 300 may supply the second control signal SBC indicating a reception state of the data driver 300 to the timing controller 200 through the second sharing signal line SSL2.

When at least one of the data driving circuits 310, of which a reception state is an abnormal state, supplies the second control signal SBC having the first value to the timing controller 200, the timing controller 200 may resupply the first control signal SFC having the first value for providing notification of the supply of the clock training signal to the data driving circuits 310, and the data driving circuits 310 may regenerate clock signals based on the first control signal SFC having the first value and the clock training signal resupplied from the timing controller 200.

As described above, the data driver 300 may include the data driving circuits 310, and the timing controller 200 may be connected to each of the data driving circuits 310 in the point-to-point method through the data clock signal line DCSL. The timing controller 200 may be connected in common to the data driving circuits 310 in the multi-drop method through the first sharing signal line SSL1. Since the equalizer setting value is transmitted to each of the data driving circuits 310 through the data clock signal line DCSL and the first control signal SFC for controlling the operation of setting the equalizer is transmitted through the first sharing signal line SSL1, there may be no need for a separate interface (or channel) for transmitting the equalizer setting value or controlling the equalizer writing operation, and there may be no need to consider the number of the data driving circuits 310 and additional lines accordingly.

Figure 3A:
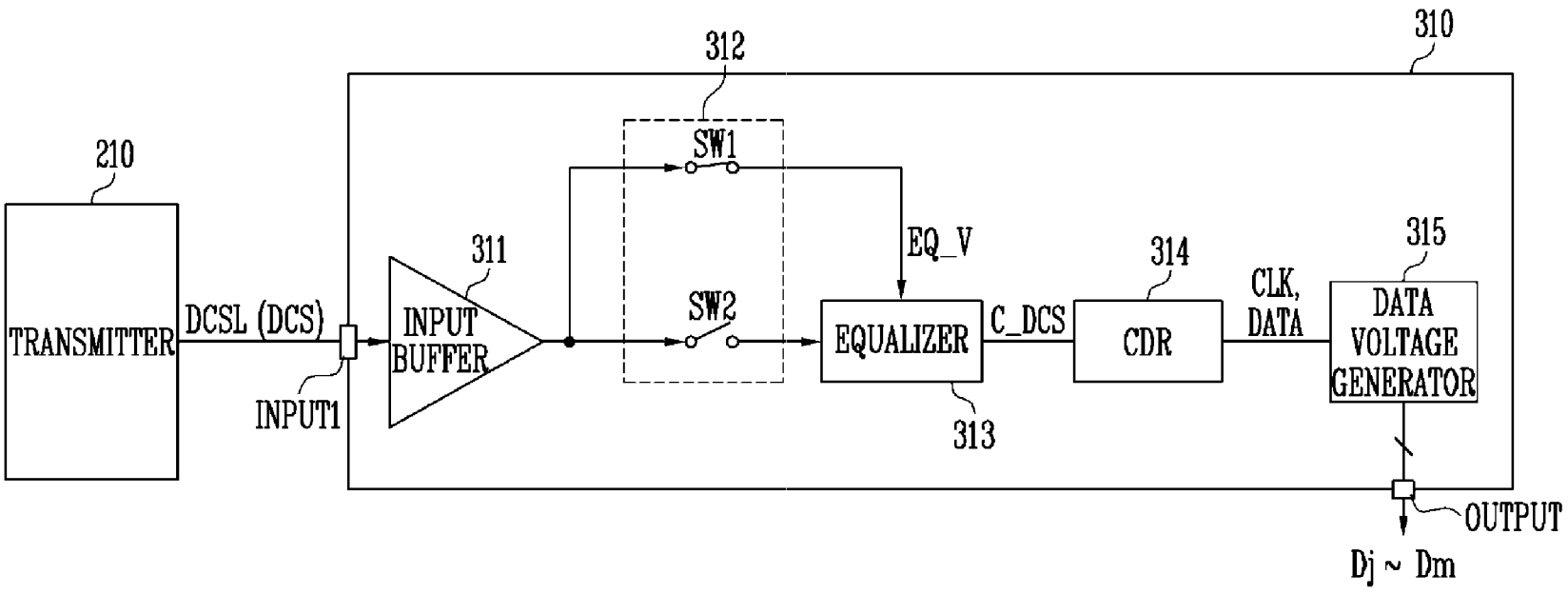
FIG. 3A is a block diagram illustrating an example of the data driving circuit of FIG. 2.
Figure 3B:
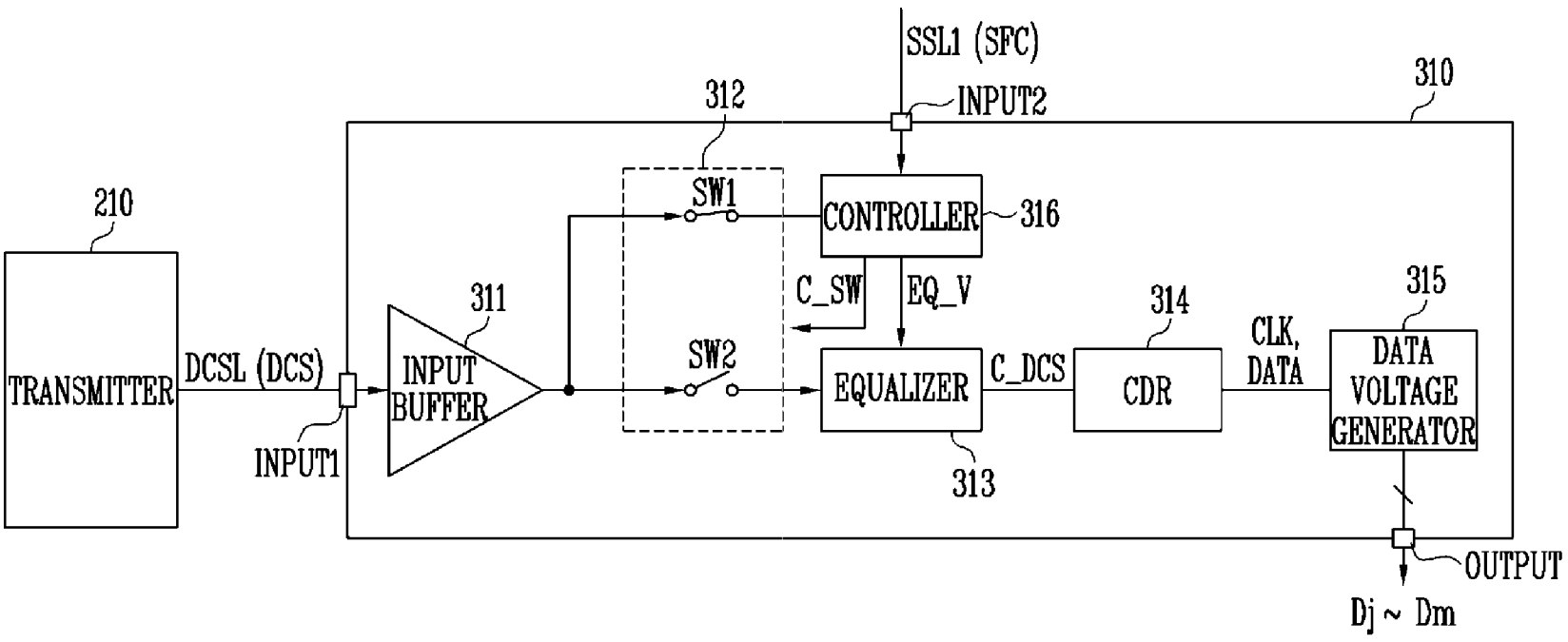
FIG. 3B is a block diagram illustrating another example of the data driving circuit of FIG. 2.
Figure 4:
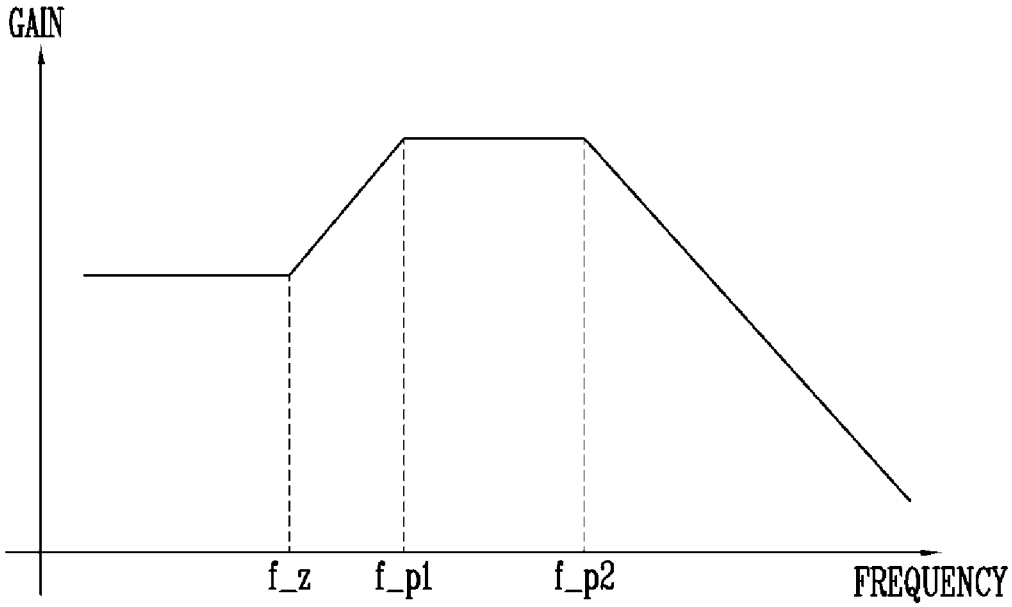
FIG. 4 is a graph for describing a frequency response characteristic of an equalizer included in the data driving circuit of FIG. 3A.
Figure 5:
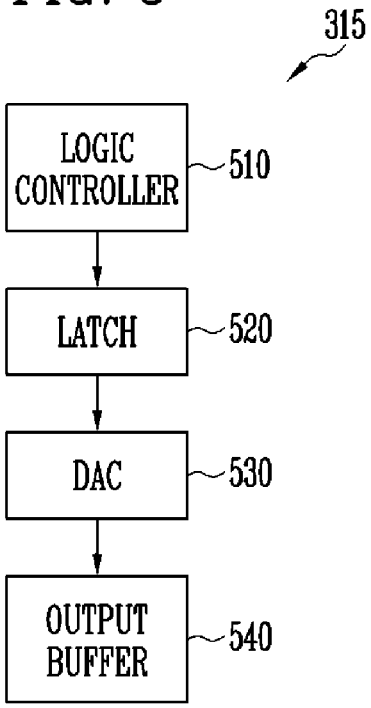
FIG. 5 is a block diagram illustrating an example of a data voltage generator included in the data driving circuit of FIG. 3A.

FIG. 3A is a block diagram illustrating an example of the data driving circuit of FIG. 2. In FIG. 3A, a data driving circuit 310 is schematically illustrated based on a data clock signal line DCSL. FIG. 3B is a block diagram illustrating another example of the data driving circuit of FIG. 2. FIG. 4 is a graph for describing a frequency response characteristic of an equalizer included in the data driving circuit of FIG. 3A. FIG. 5 is a block diagram illustrating an example of a data voltage generator included in the data driving circuit of FIG. 3A.

First, referring to FIGS. 1, 2, and 3A, since the data driving circuits 310 are substantially the same, descriptions will be given based on the data driving circuit 310 connected to data lines Dj to Dm included in a specific data line group.

A transmitter 210 of a timing controller 200 may be connected to the data driving circuit 310 through the data clock signal line DCSL. The transmitter 210 may output a data control signal DCS.

The data driving circuit 310 may include an input buffer 311, a setting unit 312 (or a setting circuit), an equalizer 313, a clock and data recoverer (CDR) (or a recovery circuit, hereinafter referred to as a recoverer 314), and a data voltage generator 315 (of a data voltage generating circuit).

The input buffer 311 may be connected to the data clock signal line DCSL through a first input terminal INPUT1. The input buffer 311 may amplify the data control signal DCS provided through the data clock line DCSL. For example, the input buffer 311 may be implemented as a comparator and may amplify and output a difference between a positive input signal and a negative input signal of the data control signal DCS. Here, the negative input signal may have a phase opposite to that of the positive input signal. According to embodiments, the input buffer 311 may be omitted.

The setting unit 312 may acquire an equalizer setting value EQ_V (or setting value) from the data control signal DCS output from the input buffer 311.

As will be described below with reference to FIG. 6, the setting unit 312 may acquire the equalizer setting value EQ_V in response to a first control signal SFC (for example, the first control signal SFC having a first pattern) transmitted through a first sharing signal line SSL1.

In one embodiment, the setting unit 312 may include a first switch SW1 and a second switch SW2 connected in parallel between the input buffer 311 (or first input terminal INPUT1) and the equalizer 313. The first switch SW1 and the second switch SW2 may alternately operate.

When a high speed interface is not applied between the transmitter 210 (or timing controller 200) and the data driver circuit 310 through the data clock signal line DCSL (that is, in the first period described above), the first switch SW1 may be turned on, and the first switch SW1 may transmit the data control signal DCS to the equalizer 313 as the equalizer setting value EQ_V. For example, the equalizer setting value EQ_V may be provided to a setting terminal of the equalizer 313 (that is, a terminal differentiated from a general input terminal to which data is applied). Since the high speed interface is not applied, the equalizer setting value EQ_V (or data control signal DCS including the same) is transmitted at a first transmission rate such that signal distortion does not occur, and for example, the first transmission rate may be a rate of several MHz to hundred MHz.

In this case, the equalizer 313 may receive the data control signal DCS provided through the first switch SW1 as the equalizer setting value EQ_V and may set a gain and/or a frequency band suitable for a high speed interface based on the equalizer setting value EQ_V. That is, a high speed interface may be applied between the transmitter 210 (or timing controller 200) and the data driving circuit 310 through the data clock signal line DCSL.

When a high speed interface is applied to the data clock signal line DCSL (that is, in the second and third periods described above), the second switch SW2 may be turned on, and the second switch SW2 may transmit the data control signal DCS to the equalizer 313 as a clock training signal and pieces of image data. Since the high speed interface is applied to the data clock signal line DCSL, the data control signal DCS may be transmitted at a second transmission rate, and the second transmission rate may be a rate of several GHz. The second transmission rate may be 10 times or more faster than the first rate.

The equalizer 313 may flatten a frequency response of the data control signal DCS. That is, the equalizer 313 may compensate for signal distortion of the data control signal DCS (for example, distortion of a high frequency component) in a transmission process between the transmitter 210 (or timing controller 200) and the data driving circuit 310.

Referring to FIG. 4, the equalizer 313 may have a specific gain GAIN in a frequency band between a first pole frequency f_p1 and a second pole frequency f_p2 and may amplify the data control signal DCS in the corresponding frequency band to compensate for signal distortion of the data control signal DCS. At zero frequency f_z, a value of the frequency response characteristic (or transfer function) of the equalizer 313 may be zero.

TABLE 1

| EQ_V | GAIN | f_z (GHz) | f_p1 (GHz) | f_p2 (GHz) |
|---|---|---|---|---|
| 1 | 1.38 | 0.90 | 1.92 | 2.0 |
| 2 | 1.23 | 0.77 | 1.85 | 2.0 |
| 3 | 1.10 | 0.66 | 1.78 | 2.0 |
| 4 | 1.00 | 0.58 | 1.70 | 2.0 |
| 5 | 0.87 | 0.47 | 1.55 | 2.0 |
| 6 | 0.75 | 0.39 | 1.49 | 2.0 |
| 7 | 0.61 | 0.30 | 1.41 | 2.0 |

Table 1 shows a bandwidth and a gain of the equalizer 313 according to the equalizer setting value EQ_V. For example, the equalizer setting values EQ_V may be expressed in 3 bits, and the equalizer 313 may set a gain and/or a frequency band suitable for a high speed interface based on one equalizer setting value EQ_V selected from among the equalizer setting values EQ_V.

For example, the equalizer 313 may include a variable resistor and a variable capacitor. The equalizer 313 may adjust a gain in a specific frequency band by adjusting a resistance value of the variable resistor and a capacitance of the variable capacitor according to the equalizer setting value EQ_V.

Meanwhile, in FIG. 3A, it has been described that the equalizer setting value EQ_V is directly provided to the equalizer 313 through the first switch SW1 of the setting unit 312, but the present disclosure is not limited thereto. For example, the data driving circuit 310 may further include a separate component for acquiring the equalizer setting value EQ_V or controlling the setting unit 312.

Referring to FIG. 3B, a data driving circuit 310 may further include a controller 316 (or a control circuit, an equalizer controller). The controller 316 may generate a switch control signal C_SW based on a first control signal SFC provided through a first sharing signal line SSL1 and a second input terminal INPUT2. In this case, a first switch SW1 and a second switch SW2 may alternately operate in response to the switch control signal C_SW. For example, the controller 316 may generate the switch control signal C_SW (or first switch control signal) having a first value in response to the first control signal SFC having a first pattern, and the first switch SW1 may be turned on in response to the switch control signal C_SW having the first value. In this case, an equalizer setting value EQ_V may be acquired from a data control signal DCS provided through the first switch SW1. For example, the controller 316 may recover the equalizer setting value EQ_V from the data control signal DCS in synchronization with the first pattern. For another example, the controller 316 may generate the switch control signal C_SW (or second switch control signal) having a second value in response to the first control signal SFC having the first value or a second value, and the second switch SW2 may be turned on in response to the switch control signal C_SW having the second value. In this case, the data control signal DCS may be provided to an equalizer 313 through the second switch SW2. According to embodiments, the controller 316 may be included in a setting unit 312.

A recoverer 314 may recover a clock signal CLK and pieces of image data from an output signal C_DCS (that is, a compensated data control signal) of the equalizer 313. For example, the recoverer 314 mat recover the clock signal CLK from the output signal C_DCS of the equalizer 313 and may recover the pieces of the image data DATA from the output signal C_DCS of the equalizer 313 in synchronization with the clock signal CLK. For example, the recoverer 314 may generate the clock signal CLK based on a clock training signal provided through a data clock signal line DCSL in a second period and may recover the pieces of the image data DATA from the compensated data control signal DCS in synchronization with the clock signal CLK.

For example, the recoverer 314 may include a phase detector, a charge pump, a loop filter, and a voltage controlled oscillator. The phase detector may output a phase difference signal by detecting a phase difference between the output signal C_DCS (that is, the clock training signal) of the equalizer 313 and the clock signal CLK (that is, a clock signal before setting is completed). The charge pump may output a current control signal according to the phase difference signal from the phase detector. The loop filter may output a voltage control signal corresponding to the current control signal. The voltage controlled oscillator may output the clock signal CLK having a frequency corresponding to a voltage level of the voltage control signal. Thus, the clock signal CLK corresponding to the clock training signal may be recovered.

A data voltage generator 315 generates data voltages corresponding to the recovered pieces of image data DATA (that is, an output signal of the recoverer 314) and may output the data voltages to data lines Dj to Dm through an output terminal OUTPUT.

Referring to FIG. 5, the data voltage generator 315 may include a logic controller 510, a latch 520, a decoder 530 (or, digital-to-analog converter (DAC)), and an output buffer 540.

The logic controller 510 may provide the pieces of image data DATA recovered by the recoverer 314 to the latch 520 in a parallelized form. In addition, the logic controller 510 may generate a latch clock signal based on the clock signal CLK recovered by the recoverer 314 and may provide the latch clock signal to the latch 520. The latch clock signal may be used to control a timing at which parallelized data is output.

The latch 520 may latch or temporarily store parallelized pieces of image data and may transmit the parallelized pieces of image data to the decoder 530.

The decoder 530 may convert digital data (that is, a grayscale value of each of the parallelized pieces of image data) into analog data voltages using gamma voltages. The gamma voltages may be generated by a separate gamma voltage generator. For example, the gamma voltage generator may generate the gamma voltages by dividing an external voltage using a resistor string.

The output buffer 540 may receive the data voltages and may output the data voltages to the data lines (that is, see "Dj to Dm" of FIG. 3A).

As described above, when the high speed interface is not applied to the data clock signal line DCSL (that is, in the first period), the data driving circuit 310 (or setting unit 312) may provide the data control signal DCS to the equalizer 313 as the equalizer setting value EQ_V to set the equalizer 313 such that the equalizer 313 has a gain and/or a frequency band suitable for a high speed interface. When the high speed interface is applied to the data clock signal line DCSL (that is, in the second period and the third period), the data driving circuit 310 (or setting unit 312) may provide the data control signal DCS to the equalizer 313 as a clock training signal and pieces of image data, thereby compensating for the data control signal DCS through the equalizer and normally recovering the clock signal CLK and the pieces of image data DATA through the recoverer 314. In particular, the data driving circuit 310 may acquire the equalizer setting value EQ_V using the first control signal SFC provided through the first sharing signal line SSL1 as an external clock signal. Therefore, a separate clock recovery process is not required before setting of the equalizer 313, and the equalizer 313 can be set more simply and quickly.

Figure 6:
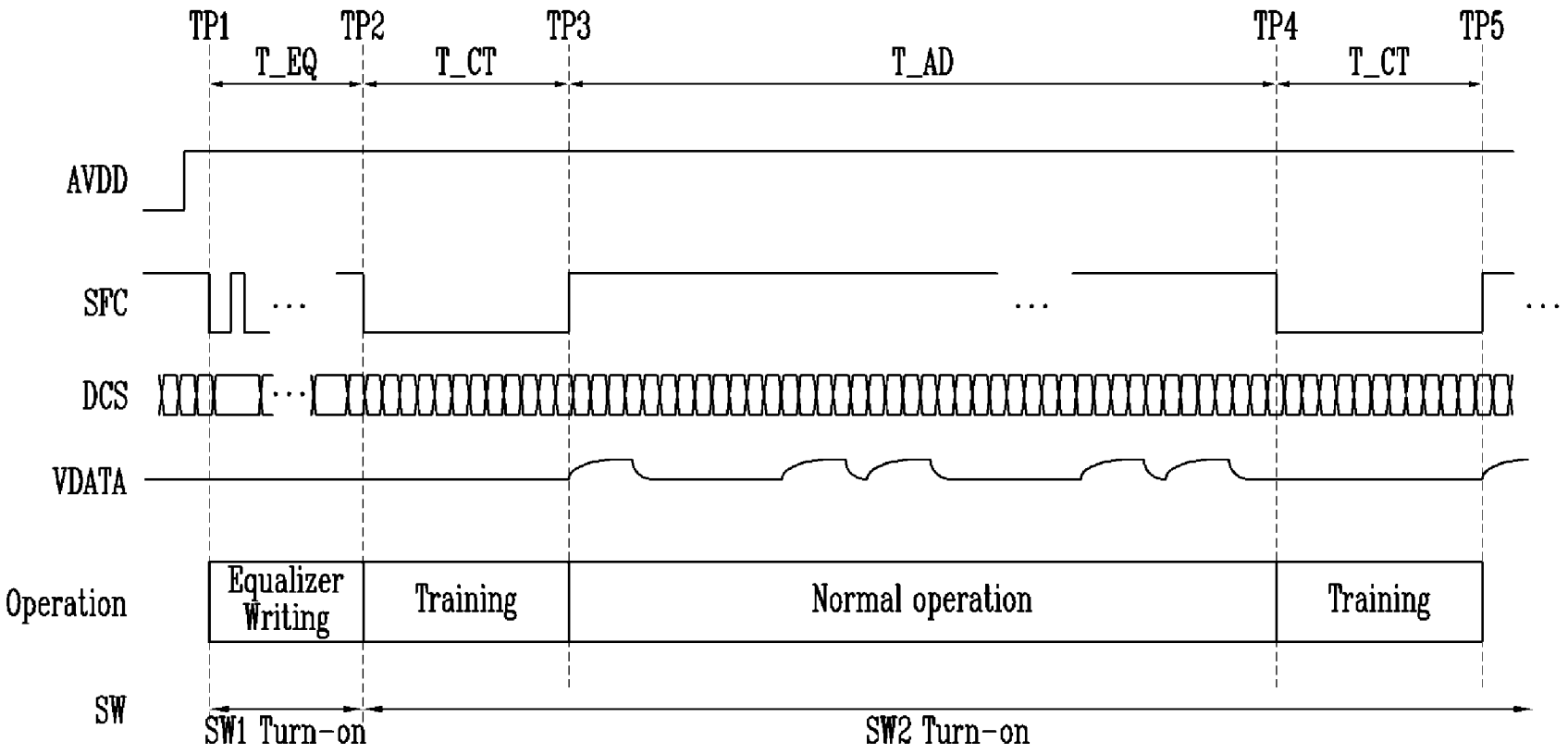
FIG. 6 is a waveform diagram for describing the operation of the data driving circuit of FIG. 3A.
Figure 7A:
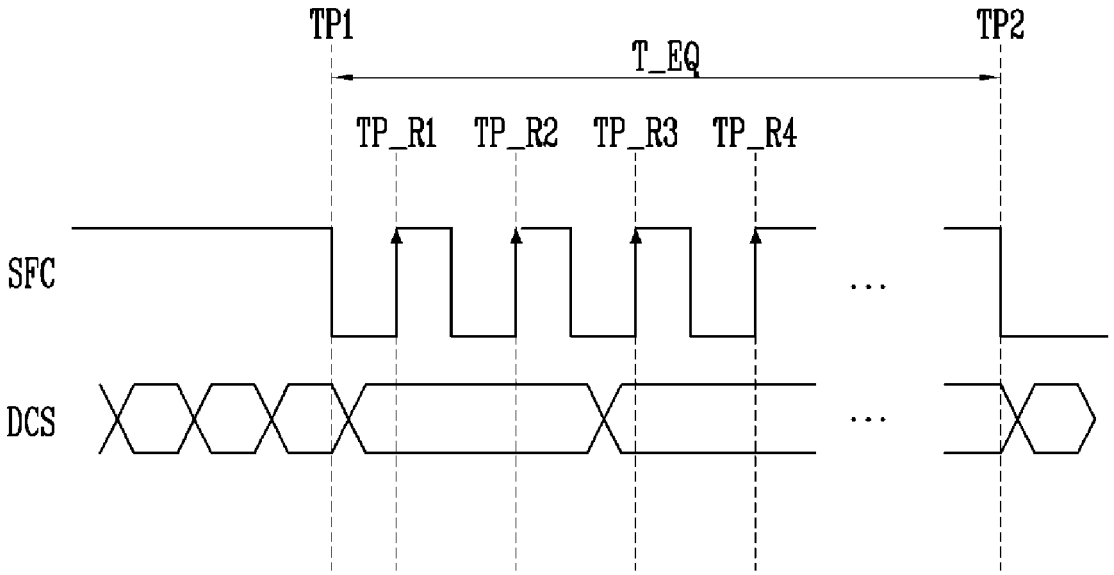
FIGS. 7A and 7B are waveform diagrams for describing the operation of the data driving circuit of FIG. 3A in a first period.
Figure 7B:
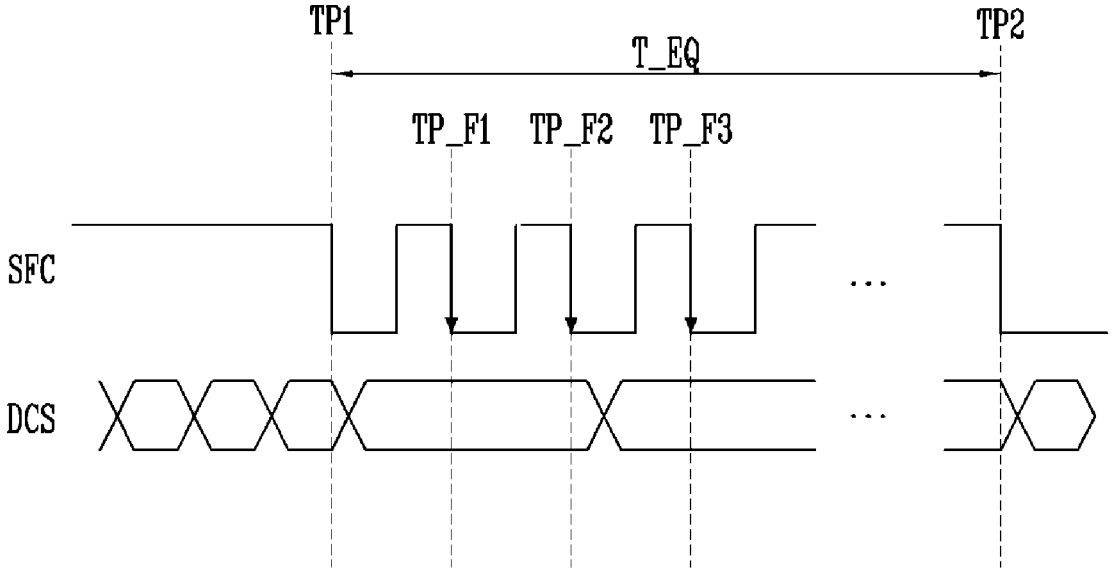

FIG. 6 is a waveform diagram for describing the operation of the data driving circuit of FIG. 3A. FIG. 6 illustrates signals measured by the data driving circuit 310 of FIGS. 3A and 3B. FIGS. 7A and 7B are waveform diagrams for describing the operation of the data driving circuit of FIG. 3A in the first period. FIGS. 7A and 7B illustrate the first control signal SFC and the data control signal DCS in the first period of FIG. 6.

Referring to FIGS. 3A, 3B, 6, 7A, and 7B, a power voltage AVDD may be provided to the data driving circuit 310. The power voltage AVDD may be a voltage required for the operation of the data driving circuit 310.

At a first time point TP1, the first control signal SFC may transition from a second value (for example, a logic high level) to a first value (for example, a logic low level). In a first period T_EQ disposed between the first time point TP1 and a second time point TP2, the first control signal SFC may have a first pattern. That is, the first control signal SFC moves back and forth between the first time point TP1 and the second time point TP2. Here, the first pattern may have a transition twice or more between the first value and the second value. For example, as shown in FIG. 6, the first pattern may transition from the second value to the first value and may transition from the first value to the second value again within a specific time. For another example, as shown in FIGS. 7A and 7B, the first pattern may have a waveform similar to that of a clock signal and may periodically have the first value and the second value.

In the first period T_EQ, the data control signal DCS may have the equalizer setting value EQ_V (see FIG. 3A) or a signal corresponding thereto.

In this case, in the first period T_EQ, in response to the first control signal SFC having the first pattern, the data driving circuit 310 may acquire the equalizer setting value EQ_V to perform an equalizer writing operation.

In the first period T_EQ, in response to the first control signal SFC having the first pattern, the first switch SW1 shown in FIGS. 3A and 3B may be turned on, and the data control signal DCS may be provided to the equalizer 313 as the equalizer setting value EQ_V.

In one embodiment, in the first period T_EQ, the data driving circuit 310 (or setting unit 312 shown in FIG. 3A or the controller 316 shown in FIG. 3B) may acquire the equalizer setting value EQ_V from the data control signal DCS using the first control signal SFC as an external clock signal.

Referring to FIG. 7A, for example, in the first period T_EQ, the data driving circuit 310 may extract the equalizer setting value EQ_V from the data control signal DCS in response to rising edges of pulses included in the first control signal SFC. For example, at a first rising time point TP_R1 at which a first rising edge of the first control signal SFC occurs, the data driving circuit 310 may obtain a bit value of 0. Thereafter, at a second rising point TP_R2 at which a second rising edge of the first control signal SFC occurs, the data driving circuit 310 may acquire a bit value of 0. At a third rising point TP_R3 and a fourth rising edge TP_R4, the data driving circuit 310 may acquire bit values of 1. In such a manner, the data driving circuit 310 may acquire the equalizer setting value EQ_V (for example, 0011, that is, a value of 3) from the data control signal DCS. The equalizer 313 may set a gain (or frequency gain) and/or a frequency band suitable for a corresponding interface based on the acquired equalizer setting value EQ_V (for example, a value of 3 shown in Table 1).

In FIG. 7A, it has been described that the data driving circuit 310 extracts the equalizer setting value EQ_V from the data control signal DCS in response to the rising edges of the pulses included in the first control signal SFC, but the present disclosure is not limited thereto. As shown in FIG. 7B, in the first period T_EQ, the data driving circuit 310 may extract the equalizer setting value EQ_V from the data control signal DCS in response to falling edges of pulses included in the first control signal SFC. For example, at first, second, and third falling time points TP_F1, TP_F2, and TP_F3 at which the falling edges of the first control signal SFC occur, each bit value of the equalizer setting value EQ_V may be acquired.

Meanwhile, since pieces of image data are not recovered in the first period T_EQ, a data voltage VDATA output through the data driving circuit 310 (or data voltage generator 315 shown in FIGS. 3A and 3B) may not have a valid value.

Thereafter, at the second time point TP2, the first control signal SFC may transition from the second value to the first value, and in a second period T_CT disposed between the second time point TP2 and a third time point TP3, the first control signal SFC may be maintained at the first value. In addition, in the second period T_CT, the data control signal DCS may have a clock training signal.

In this case, in the second period T_CT, the data driving circuit 310 may perform a training operation (that is, a clock signal recovery operation) in response to the first control signal SFC having the first value.

In the second period T_CT, in response to the first control signal SFC having the first value, the second switch SW2 shown in FIGS. 3A and 3B may be turned on, and the data control signal DCS may be provided to the equalizer 313 as a clock training signal. In this case, the signal distortion of the clock training signal may be compensated for through the equalizer 313, and the recoverer 314 may recover the clock signal (see "CLK" of FIG. 3A) using the compensated clock training signal.

Meanwhile, since pieces of image data are not recovered in the second period T_CT, the data voltage VDATA output through the data driving circuit 310 (or data voltage generator 315 shown in FIGS. 3A and 3B) may not have a valid value.

Thereafter, at the third time point TP3, the first control signal SFC may transition from the first value to the second value, and in a third period T_AD disposed between the third time point TP3 and a fourth time point TP4, the first control signal SFC may be maintained at the second value. In addition, in the third period T_AD, the data control signal DCS may have pieces of image data.

In this case, in the third period T_AD, the data driving circuit 310 may perform general operations of the data driving circuit 310 (that is, a recovering operation of pieces of image data and a data voltage generating operation) in response to the first control signal SFC having the second value.

In the third period T_AD, in response to the first control signal SFC having the second value, the second switch SW2 shown in FIGS. 3A and 3B may maintain a state of being turned on, and the data control signal DCS may be provided to the equalizer 313 as pieces of image data. In this case, the signal distortion of the pieces of image data may be compensated for through the equalizer 313, and the recoverer 314 may recover the pieces of image data in synchronization with the previously recovered clock signal CLK. The recovered clock signal CLK and the recovered pieces of image data DATA may be provided to the data voltage generator 315, and the data voltage generator 315 may generate data voltages corresponding to the recovered pieces of image data DATA. Accordingly, the data voltage VDATA output through the data driving circuit 310 (or data voltage generator 315) may have a valid value.

A fourth period T_CT disposed between the fourth time point TP4 and a fifth time point TP5 may be substantially the same as the second period T_CT. For example, when a specific time elapses from the second period T_CT or when the locking of the clock signal CLK fails, the first control signal SFC has the first value again, and the data driving circuit 310 may perform a training operation (that is, a clock signal recovery operation) in response to the first control signal SFC having the first value.

Meanwhile, the first period T_EQ, the second period T_CT, and the third period T_AD may be included in one frame (or frame period), but the present disclosure is not limited thereto. For example, the third period T_AD may be greater than one frame. That is, when the clock signal CLK is maintained in a locked state, the third period T_AD may last during one or more frames.

As described above, in the first period T_EQ, in response to the first control signal SFC, the data driving circuit 310 may perform an equalizer writing operation using the data control signal DCS (that is, the data control signal DCS including the equalizer setting value EQ_V). In the second period T_CT after the first period T_EQ (that is, after a high speed interface is applied), the data driving circuit 310 may perform a training operation. In addition, in the first period T-EQ, the data driving circuit 310 may acquire the equalizer setting value EQ_V using the first control signal SFC provided through the first sharing signal line SSL1 as an external clock signal, thereby more correctly setting the equalizer 313 without a separate clock recovery process.

In a data driving circuit and a display device according to embodiments of the present disclosure, an equalizer can be set using an equalizer setting value transmitted at a relatively low rate through a data clock signal line in a point-to-point type, and after the equalizer is set (that is, after a high speed serial interface is applied), a clock signal can be recovered using a clock training signal transmitted at a relatively high rate. Accordingly, there is no need for a separate interface (or channel) for transmitting an equalizer setting value or controlling an equalizer writing operation, and manufacturing costs of a display device can be reduced.

In addition, since an equalizer setting value is acquired using a first control signal transmitted through a sharing signal line in a multi-drop type as an external clock signal, a separate clock recovery process is not required before an equalizer is set, and it is possible to more quickly set the equalizer.

The referenced drawings and the detailed description of the disclosure are provided merely for the purpose of explaining example embodiments of the disclosure, and are not intended to limit the technical scope of the disclosure defined by the following claims. Therefore, an ordinary skilled person in the art will understand that a variety of changes and equivalent embodiments can be made from the foregoing description. The technical scope of the disclosure should thus be defined by the technical ideas of the following claims.

What is claimed is:

1. A display device comprising:

a display panel including pixels;

a timing controller configured to generate a first control signal and data control signals; and a plurality of data driving circuits, wherein each of data driving circuits recovers a data signal from a corresponding data control signal of the data control signals in response to the first control signal, generates a data voltage corresponding to the data signal, and provides the data voltage to the display panel, and wherein each of the data driving circuits includes:

a setting unit including a first switch and a second switch connected in parallel with the first switch configured to acquire a setting value from the data control signal in response to the first control signal;

an equalizer configured to compensate for distortion of the corresponding data control signal according to the setting value to output compensated data control signal; and a recoverer configured to recover a clock signal from the compensated data control signal and recover the data signal from the compensated data control signal based on the clock signal.

2. The display device of claim 1, further comprising:

a first sharing signal line connected in common to the data driving circuits and configured to transmit the first control signal from the timing controller to the data driving circuits; and data clock signal lines, each of the data clock signal lines connected to each of the data driving circuits and configured to respectively transmit a data driving control signal.

3. The display device of claim 2, wherein the first sharing signal line is a one-way transmission line from the timing controller to the data driving circuits, and wherein each of the data clock signal lines is a one-way transmission line from the timing controller to each of the data driving circuits.

4. The display device of claim 2, wherein at least some of the data control signals include different setting values for the equalizer.

5. The display device of claim 1, wherein the the first switch and the second switch are disposed between the timing controller and the equalizer, wherein the first switch transmits the data control signal as the setting value at a first transmission rate in a first period, wherein the second switch transmits the data control signal at a second transmission rate in a second period after the first period, and wherein the second transmission rate is about 10 times or more faster than the first rate.

6. The display device of claim 5, wherein the setting unit further includes a controller configured to acquire the setting value from the corresponding data control signal provided through the first switch in response to the first control signal having a first pattern.

7. The display device of claim 1, wherein, in a first period, the setting unit acquires the setting value from the data control signal using the first control signal as an external clock signal.

8. The display device of claim 7, wherein the data driving circuits simultaneously set the equalizers in the first period.

9. The display device of claim 7, wherein, in the first period, the setting unit extracts the setting value from the corresponding data control signal in response to a rising edge of each of pulses included in the first control signal.

10. The display device of claim 7, wherein, in the first period, the setting unit extracts the setting value from the corresponding data control signal in response to a falling edge of each of pulses included in the first control signal.

11. The display device of claim 7, wherein, in a first sub-period of a second period, the recoverer recovers the clock signal from the compensated data control signal, wherein, in a second sub-period after the first sub-period of the second period, the recoverer recovers the data signal from the compensated data control signal based on the clock signal, and wherein the second period is allocated after the first period.

12. The display device of claim 1, wherein each of the data driving circuits further includes:

an input buffer connected between the timing controller and the setting unit and configured to amplify and output the corresponding data control signal; and a data voltage generator configured to generate a data voltage corresponding to the data signal output from the recoverer.

13. The display device of claim 1, wherein the setting unit acquires the setting value in response to the first control signal having a first pattern, wherein the recoverer recovers the clock signal in response to the first control signal having a first value and recovers the data signal in response to the first control signal having a second value, and wherein the first pattern includes a transition twice or more between the first value and the second value for a specific time.

14. A data driving circuit for receiving a data control signal through a first input terminal, the data driving circuit comprising:

a setting unit including a first switch and a second switch connected in parallel with the first switch configured to acquire a setting value from the data control signal in response to the first control signal;

an equalizer configured to compensate for distortion of the data control signal according to the setting value and output compensated data control signal;

a recoverer configured to recover a clock signal from the compensated data control signal and recover a data signal from the compensated data control signal based on the clock signal; and a data voltage generator configured to generate a data voltage corresponding to the data signal output from the recoverer.

15. The data driving circuit of claim 14, wherein the first switch and the second switch are disposed between the timing controller and the equalizer, wherein the first switch transmits the data control signal as the setting value at a first transmission rate in a first period, wherein the second switch transmits the data control signal at a second transmission rate in a second period after the first period, and wherein the second transmission rate is about 10 times or more faster than the first rate.

16. The data driving circuit of claim 15, wherein, in the first period, the setting unit acquires the setting value from the data control signal using a first control signal provided through a second input terminal as an external clock signal.

17. The data driving circuit of claim 16, wherein, in the first period, the setting unit extracts the setting value from the corresponding data control signal in response to a rising edge of each of pulses included in the first control signal.

18. The data driving circuit of claim 16, wherein, in the first period, the setting unit extracts the setting value from the corresponding data control signal in response to a falling edge of each of pulses included in the first control signal.

19. The data driving circuit of claim 16, wherein, in a first sub-period of a second period, the recoverer recovers the clock signal from the compensated data control signal, and wherein, in a second sub-period after the first sub-period of the second period, the recoverer recovers the data signal from the compensated data control signal based on the clock signal.

20. The data driving circuit of claim 14, further comprising an input buffer connected between the first input terminal and the setting unit and configured to amplify and output the corresponding data control signal.

* * * * *